US008167701B2

(12) United States Patent
Oakes et al.

(10) Patent No.: US 8,167,701 B2
(45) Date of Patent: May 1, 2012

(54) SYSTEMS AND METHODS FOR LOTTERY-STYLE GAMES

(75) Inventors: James Allan Oakes, Rye (GB); Henry Edwards Oakes, Hastings (GB)

(73) Assignee: Roboreus Limited (GB)

( * ) Notice: Subject to any disclaimer, the term of this patent is extended or adjusted under 35 U.S.C. 154(b) by 916 days.

(21) Appl. No.: 12/180,201

(22) Filed: Jul. 25, 2008

(65) Prior Publication Data

US 2010/0022290 A1 Jan. 28, 2010

(51) Int. Cl.

| | |
|---|---|
| ***A63F 9/24*** | (2006.01) |
| ***A63F 3/06*** | (2006.01) |
| ***A63F 3/04*** | (2006.01) |
| ***A63B 71/00*** | (2006.01) |

(52) U.S. Cl. ..... 463/17; 463/26; 273/138.1; 273/269

(58) Field of Classification Search ..... 463/17–19, 463/25–28, 30, 42; 273/269, 274, 138.1
See application file for complete search history.

(56) References Cited

U.S. PATENT DOCUMENTS

| | | | | |
|---|---|---|---|---|
| 6,015,345 | A | 1/2000 | Kail | |
| 6,146,272 | A * | 11/2000 | Walker et al. | 463/17 |
| 6,203,427 | B1 | 3/2001 | Walker et al. | |
| 6,296,569 | B1 | 10/2001 | Congello, Jr. | |
| 6,454,650 | B1 | 9/2002 | Aronin | |
| 6,554,710 | B1 | 4/2003 | Olson | |
| 6,802,505 | B2 | 10/2004 | Jeon | |
| 6,881,148 | B2 * | 4/2005 | Yotsugi et al. | 463/42 |
| 7,058,593 | B1 | 6/2006 | Merritt | |
| 7,094,154 | B2 | 8/2006 | Kellerman et al. | |
| 7,351,142 | B2 | 4/2008 | Walker et al. | |
| 2002/0037766 | A1 | 3/2002 | Muniz | |
| 2003/0073481 | A1 | 4/2003 | Bennett | |
| 2003/0114211 | A1 * | 6/2003 | White | 463/17 |
| 2003/0224847 | A1 | 12/2003 | Jaimet | |
| 2004/0137980 | A1 | 7/2004 | Aenlle | |
| 2004/0236629 | A1 | 11/2004 | Martin | |
| 2004/0242310 | A1 | 12/2004 | Perkins | |
| 2005/0027595 | A1 | 2/2005 | Ha et al. | |
| 2006/0063587 | A1 | 3/2006 | Manzo | |
| 2006/0100008 | A1 | 5/2006 | Wright et al. | |
| 2006/0160602 | A1 | 7/2006 | Blythe et al. | |

(Continued)

OTHER PUBLICATIONS

PCT International Search Report (Aug. 6, 2009).

(Continued)

*Primary Examiner* — David L Lewis
*Assistant Examiner* — Robert Mosser
(74) *Attorney, Agent, or Firm* — Goodwin Procter, LLP

(57) ABSTRACT

Systems and methods for lottery-style games are disclosed. In one exemplary embodiment, a computer-implemented method may comprise: establishing a map-based game that is scheduled to have a number of lottery drawings associated with a plurality of grid units on a map; accepting enrollment of players in the map-based game, each player being associated with at least one grid unit on the map and being committed to participate in a plurality of the lottery drawings by contributing tokens of value; receiving, from each player, a designated number of tokens to be contributed, on behalf of each of the at least one grid unit, to each lottery drawing said player is committed to participate in; and executing the map-based game by pooling the contributed tokens to form a jackpot and conducting a drawing, from grid units participating in said drawing, to select at least one grid unit to win a first prize.

22 Claims, 12 Drawing Sheets

U.S. PATENT DOCUMENTS

| | | | |
|---|---|---|---|
| 2006/0281555 | A1 | 12/2006 | Kellerman et al. |
| 2007/0077981 | A1 | 4/2007 | Hungate et al. |
| 2007/0130000 | A1 | 6/2007 | Assanassios |
| 2007/0162340 | A1 | 7/2007 | Spinoso |
| 2007/0244757 | A1 | 10/2007 | Walter |
| 2008/0102933 | A1 | 5/2008 | Jones et al. |
| 2008/0220840 | A1 | 9/2008 | Katz et al. |
| 2009/0036192 | A1 | 2/2009 | Hughes |
| 2009/0061980 | A1 | 3/2009 | Holton et al. |
| 2009/0117989 | A1 | 5/2009 | Arezina et al. |
| 2009/0271257 | A1 | 10/2009 | Flake et al. |
| 2010/0062840 | A1 | 3/2010 | Herrmann |
| 2010/0069137 | A1 | 3/2010 | D'Angelo |
| 2010/0069151 | A1 | 3/2010 | Suchocki |
| 2010/0273548 | A1 | 10/2010 | Bozeman |
| 2011/0092267 | A1 | 4/2011 | Hardy et al. |

OTHER PUBLICATIONS

PCT Written Opinion of the International Searching Authority (Aug. 6, 2009).

* cited by examiner

FIG. 9

| | 1 | 2 | 3 | 4 | 5 | 6 | 7 | 8 | 9 | 10 |
|---|---|---|---|---|---|---|---|---|---|---|
| A | | | | | | | | | | |
| B | | | | 3rd Prize | 3rd Prize | 3rd Prize | 3rd Prize | 3rd Prize | | |
| C | | | | 3rd Prize | 2nd Prize | 2nd Prize | 2nd Prize | 3rd Prize | | |
| D | | | | 3rd Prize | 2nd Prize | **1st Prize** | 2nd Prize | 3rd Prize | | |
| E | | | | 3rd Prize | 2nd Prize | 2nd Prize | 2nd Prize | 3rd Prize | | |
| F | | | | 3rd Prize | 3rd Prize | 3rd Prize | 3rd Prize | 3rd Prize | | |
| G | | | | | | | | | | |
| H | | | | | | | | | | |

SYSTEMS AND METHODS FOR LOTTERY-STYLE GAMES

CROSS REFERENCE TO RELATED APPLICATIONS

This patent application is related to U.S. patent application Ser. No. 12,180,263, entitled "Systems and Methods for Lottery-Style Games," filed concurrently herewith, which is incorporated herein in its entirety.

FIELD OF THE INVENTION

Embodiments of the present invention relate generally to games of chance. More specifically, the present invention relates to systems and methods for lottery-style games.

BACKGROUND OF THE INVENTION

Lottery is a popular game of chance in which a number of players contribute to form a jackpot that is later awarded, wholly or partially, to one or more winners. The participating players pay money or contribute other things of value in exchange for lottery tickets. Typically, each lottery ticket bears a combination of numbers or other symbols, and a winning ticket has to at least partially match a randomly generated set of numbers or symbols. In a properly operated lottery game, any one of the outstanding lottery tickets could be selected in a random drawing as a winning ticket, entitling its holder to some or all of the jackpot prize.

Sweepstakes in United States may be considered one special type of lottery games which are free to enter and are typically sponsored by merchants for promotional marketing purposes. In United Kingdom, a sweepstake is technically a lottery game in which the prize is financed through the tickets sold. Small-scale sweepstakes among private parties (e.g., colleagues and classmates) may also be considered lottery games which are often related to ongoing sports events.

Lottery games come in different formats. For example, the jackpot of a lottery game may be either a fixed cash amount or a certain percentage of ticket revenue. The combination of numbers on each lottery ticket could be a unique one, or each player may be allowed to select his or her own lucky numbers, making it possible for multiple tickets to share a same combination. Lottery games can be played either online or offline. The most popular lottery games, such as Powerball™, Mega Millions™, and Euro Millions™, are mostly paper-based, requiring the purchase of actual tickets, although some are now starting to open to online participants. A few lottery games can be played completely online. That is, instead of purchasing a paper ticket and filling in desired numbers with a pencil, an online player can purchase an electronic (or virtual) lottery ticket and select a desired combination via a web interface such as an Internet browser.

In all traditional lottery games, lottery tickets are sold in predetermined, fixed denominations, for example, one dollar per ticket. Accordingly, one winning ticket will entitle its holder to an entire unit of a corresponding winning prize. Proportional value lottery games have been proposed, for example, in U.S. Pat. Nos. 6,296,569 and 7,351,142, but none appears to have been commercially implemented. Both of those patents describe the issuance of proportional denomination lottery tickets, online or at a point of sale (POS). For example, in any transaction involving change under a dollar, the change can be converted to a proportional denomination share of a full-unit (one-dollar) lottery ticket. If the full-unit lottery ticket is qualified for a prize, the holder of the proportional denomination ticket will be entitled to a fraction of the prize. For instance, if a one-dollar ticket matching all the winning numbers would entitle its holder to a jackpot amount, then a 25-cent proportional ticket entitles its holder to 25% of the jackpot.

All the existing types of lottery games appear to share a few common characteristics. First, they all have to issue some kind of lottery tickets, whether paper or electronic, full-denomination or proportional. The purposes for issuing lottery tickets are two-fold. The tickets bear numerical combinations or patterns to be compared to the randomly generated winning combination or pattern. The tickets also serve as proof of participation in the lottery games. However, the entire mechanism of generating, drawing, and matching tickets could impose significant overhead costs on the operation of lottery games.

Second, participation in traditional lottery games depends heavily on player impulse or enthusiasm, which causes ticket revenue to fluctuate. Except for a handful of gambling fanatics, most people only purchase lottery tickets occasionally. A loss in one game might cause an ordinary player to stop playing for a while. Also, public sentiment towards a lottery game often varies with the amount of jackpot prize available at the time. There seems to be a general belief that a one-dollar ticket somehow has a better chance of winning when the jackpot reaches several million dollars or more. Therefore, when the total jackpot snowballs into an unusually large amount, the public often become increasingly interested in the game. Once the jackpot is won, a period of stagnation typically follows the news-generating big win. For all these reasons, ticket revenues from traditional lottery games tend to swing with time and seldom generate a steady cash flow.

Third, players in a traditional lottery game have no direct or perceivable incentive for bringing more players into the game. Theoretically, an existing player may be indirectly benefited if more players join the lottery game, because the increased participation will increase the size of jackpot the existing player could potentially win. However, that potential benefit may not be tangible enough to encourage referrals of additional players. In addition, the existing player's chance of winning does not increase with the number of new players.

Furthermore, traditional lottery games including sweepstakes are pure games of chance and typically do not require any player skill or strategy. Every player's chance of winning is only affected by the number of lottery tickets he or she buys. One player's chance of winner is independent of another player's chance of winning. As a result, there tends to be very little interaction among lottery participants.

In view of the foregoing, it may be understood that there are significant problems and shortcomings associated with traditional lottery games.

SUMMARY OF THE INVENTION

Systems and methods for lottery-style games are disclosed. In one particular exemplary embodiment, a computer-implemented method for lottery-style games may comprise: establishing a map-based game that is scheduled to have a number of lottery drawings associated with a plurality of grid units on a map; accepting enrollment of a plurality of players in the map-based game, each player being associated with at least one grid unit on the map and being committed to participate in a plurality of the lottery drawings by contributing tokens of value; receiving, from each player, a designated number of tokens to be contributed, on behalf of each of the at least one grid unit, to each of the plurality of the lottery drawings said player is committed to participate in; and executing the map-based game by doing the following for each lottery drawing: pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize. In addition, one or more second grid units may be selected to win lesser prizes, the selection being based on relative map positions of the one or more second grid units with respect to the at least one first grid unit.

In another particular exemplary embodiment, a system for lottery-style games may comprise: a processor; at least one storage device coupled to the processor; a user interface coupled to the processor via one or more communication networks; wherein the processor is adapted to communicate with the at least one storage device and the user interface to execute instructions to perform the following tasks: establishing a map-based game that is scheduled to have a number of lottery drawings associated with a plurality of grid units on a map; accepting enrollment of a plurality of players in the map-based game, each player being associated with at least one grid unit on the map and being committed to participate in a plurality of the lottery drawings by contributing tokens of value; receiving, from each player, a designated number of tokens to be contributed, on behalf of each of the at least one grid unit, to each of the plurality of the lottery drawings said payer is committed to participate in; and executing the map-based game by doing the following for each lottery drawing: pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize.

One technical effect of the systems and methods of the present invention is that they facilitate more efficient and more entertaining implementation of lottery-style games on modern computers and communications systems. Another technical effect of the systems and methods of the present invention lies in the specialized computer devices and/or gaming kiosks that may be configured and deployed to carry out the lottery-style games disclosed herein.

The present invention will now be described in more detail with reference to exemplary embodiments thereof as shown in the accompanying drawings. While the present invention is described below with reference to exemplary embodiments, it should be understood that the present invention is not limited thereto. Those of ordinary skill in the art having access to the teachings herein will recognize additional implementations, modifications, and embodiments, as well as other fields of use, which are within the scope of the present invention as described herein, and with respect to which the present invention may be of significant utility.

BRIEF DESCRIPTION OF THE DRAWINGS

In order to facilitate a fuller understanding of the present invention, reference is now made to the accompanying drawings, in which like elements are referenced with like numerals. These drawings should not be construed as limiting the present invention, but are intended to be exemplary only.

FIG. 9 illustrates another alternative payout structure in an exemplary GeoSweep game in accordance with one embodiment of the present invention.

DETAILED DESCRIPTION OF THE INVENTION

Figure 1:
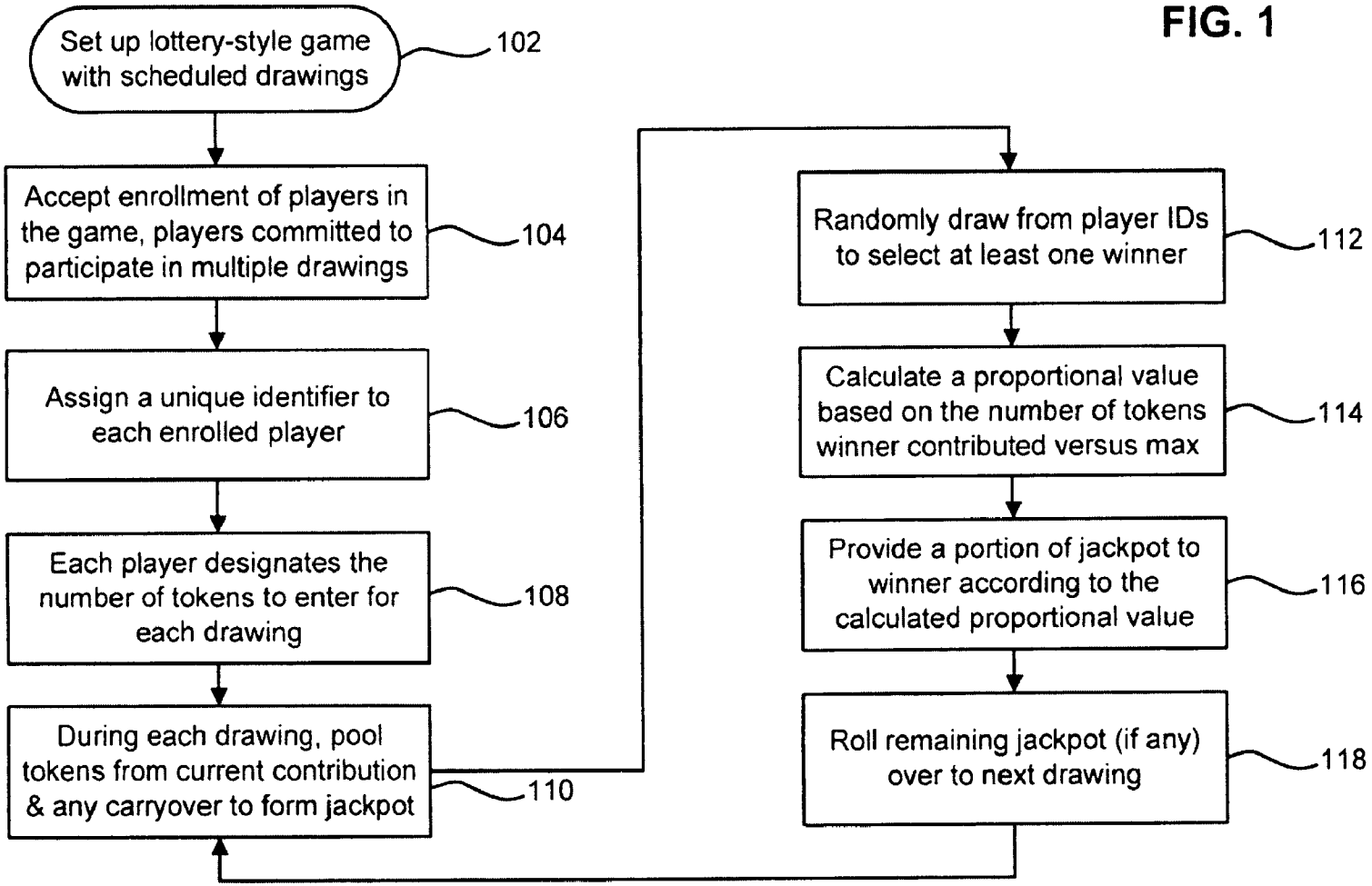
FIG. 1 is a flow chart illustrating an exemplary method of facilitating lottery-style games in accordance with one embodiment of the present invention.

Referring to FIG. 1, there is shown a flow chart illustrating an exemplary method of facilitating lottery-style games in accordance with one embodiment of the present invention.

In step 102, a lottery game may be set up. The lottery game may be an ongoing one that is scheduled to have a plurality of lottery drawings over a period of time. For example, the lottery drawings may occur on a periodic basis, such as once every hour, one or more times every calendar day or every business day, one or more times every week, or a predetermined number of times per month or year. As the lottery game is set up, a set of rules, terms and conditions may be published or otherwise communicated to potential participants. The rules may define how the lottery game is operated and how the lottery drawings are conducted, as well as calculation and payout of prizes, as will be described in more detail below. The terms and conditions may specify rights and obligations of persons participating in the lottery game and lottery drawings.

In preferred embodiments of the present invention, the lottery game is established online and accessible via an Internet website. The lottery game may also be implemented in connection with one or more social networking websites, such as Facebook™, MySpace™, or LinkedIn™. Alternatively, the lottery game may also be implemented in connection with one or more virtual reality games such as Second Life™ or other multi-player video games. The lottery game may be either an add-on or an integrated part of an associated website, wherein participation in the lottery game may enhance a player's experience at the associated website or vice versa. According to some embodiments, the lottery game and lottery drawings may be implemented at least partially offline, without requiring every participant to have computer or Internet access.

In step 104, players may be enrolled in the lottery game. Each person wishing to join the lottery game may be required to make a commitment to participate in a number of the scheduled lottery drawings. In one exemplary enrollment process, a player may (a) manifest consent to the set of rules, terms and conditions established in the lottery game and (b) deposit or pledge some amount of money or other things of value to be contributed to the game. The amount of initial deposit or pledge may depend on such factors as how many lottery drawings the player is obligated to participate in, how much wager the player is to enter for each drawing, the player's credit ratings, and so on.

Enrollment of players may be taken via a web interface, by mail, or through other communication means. When the lottery game is implemented in connection with a social networking website or other membership sites, enrollment in the lottery game may be simplified with the existing membership information. Alternatively, the lottery game operator, administrator, or personnel may receive and approve enrollment in person. In some instances, new players may join through referrals and/or gift membership.

In step 106, each enrolled player may be assigned one or more unique identifiers. Each player identifier (or player ID) may be a text string, a serial number, or other symbols. According to one embodiment, each player ID may be associated with a "Lucky Star" of the player's choice. According to some embodiments, each player ID may comprise a machine readable portion (e.g., an alphanumeric string) and a human recognizable portion (e.g., a logo, icon or catch phrase). For a player, one of the assigned player IDs may be used as a username for logging into an Internet-based lottery game. Or, the player may choose a different username to log in but is still able to manage multiple player IDs assigned to that player. The assigned player IDs may be imprinted or encoded on a membership card.

In the drawings or games described herein, each registered player can participate with one or multiple player IDs. When participating with multiple player IDs, the rules regarding each of the multiple player IDs are the same as if each player ID is owned and controlled by a single player. For ease of illustration, it is assumed in the following description that each player participates with a single player ID.

In step 108, each player may designate the number of tokens to enter for each drawing. That is, with respect to each lottery drawing the player is committed to participate in, the player may specify a wager amount that is typically measured in the number of tokens. As used herein, a "token" may be or represent any physical or virtual thing of value that can be counted or quantified. For example, a token may be or represent one or more units of cash or credit. Or, a token may be or represent one or more points that are exchangeable for things of value. According to one embodiment of the present invention, one token may be the equivalent of one cent (1/100 of a dollar). According to another embodiment, one token may be or represent one value point that may be used to exchange for music downloads, cell phone ring-tones, or for other online or in-store purchases. According to yet another embodiment, one token may represent one unit of a game score in an online video game or a virtual society. According to still another embodiment, one token may be or can be exchanged for one or more units of mobile telephone airtime or long-distance telephone minutes.

The players may purchase tokens with their initial deposits. They may set up electronic fund transfers and/or automatic credit card payments to refill their accounts with tokens. A player's account may be replenished automatically as soon as its balance falls below a preset lower limit. Apart from winning or purchasing refills, the players may alternatively or additionally obtain tokens through bartering or by engaging in certain activities. For example, a player may exchange credit card cash-back bonus points for tokens. The player may also take part in online surveys, view online advertisements, or increase activity level at social networking or blogger websites to earn tokens.

The number of tokens designated for each lottery drawing should typically fall within a certain range. For lottery drawings that take place on a daily basis, for example, there may be a daily minimum and a daily maximum for the number of tokens a player can contribute per player ID. According to one embodiment of the present invention, the daily minimum may be one token (e.g., one cent or one pence) and the daily maximum may be one hundred tokens (e.g., one dollar or one pound). The number of tokens that a player designates for each drawing may be any of a fixed value between and including the daily minimum and the daily maximum. Alternatively, the player may configure the daily wager to be a variable amount. To have a minimal level of participation in the lottery game (thus a more predictable revenue from the game), the game system may be configured to prevent players from lowering their preset daily wager amount for any upcoming drawings.

For each lottery drawing, a jackpot prize may be formed, in step 110, from two sources: (a) tokens contributed by players who participate in that drawing, and (b) tokens carried over from one or more previous drawings, if available. Tokens from the two sources may be pooled together into one jackpot. The jackpot (or a portion thereof) may account for a maximum payable amount for a winner of that lottery drawing.

In step 112, a random drawing from the player IDs may be conducted to select at least one winner. Note that the word "random" does not require randomness in the most rigorous statistical sense as such randomness is difficult to achieve. Instead, the word "random" implies a fair drawing process that does not appear to favor any one player more than any other player. The random (fair) drawing from the player IDs may be achieved in a number of computational methods as are well known in the gaming industry. According to some embodiments of the present invention, a single winner may be selected for each lottery drawing. According to some alternative embodiments, two or more winners may be selected for each drawing and they may share a prize fund on equal footings or according to an award hierarchy.

Then, in step 114, a proportional value may be calculated based on the number of tokens the selected winner(s) contributed versus the maximum number allowed per player ID. Assuming there is only one selected winner, the proportional value (F) may be calculated by dividing the number of tokens the winner contributed (n) with the maximum number a player is allowed to contribute (M) to that individual lottery drawing. That is—

$$F = \frac{n}{M}$$

If there are multiple winners, the proportional value may be calculated for each winner. For example, if a selected winner contributed the maximum number of tokens for that lottery drawing, the proportional value for that winner would be one (1) or 100%. If the selected winner contributed half of the maximum number of tokens allowed, the proportional value would be ½ or 50%. The proportional value calculated in this step may be represented with either a fraction or a percentage.

In step 116, a fraction of the jackpot (or maximum payable prize) may be provided to the selected winner(s) according to the proportional value calculated in step 114 above. That is, whatever the full prize amount (P) a winner might have been entitled to had he or she contributed the maximum number of tokens (M), the actual payout amount (p) may be reduced to a fraction of that full prize amount in proportion to the number of tokens contributed (n). That is—

$$p = F \times P = \frac{n}{M} \times P$$

The same proportional payout rule applies to single-winner as well as multiple-winner scenarios. The actual payout may be made by depositing tokens into a winner's account in the game system. Alternatively, the winner may receive the prize in the form of cash, points, airtime or long-distance minutes, other things of value, or a combination thereof. Other payout arrangements are also possible.

In step 118, the remainder of the jackpot prize may be rolled over to a next drawing. Unless one or more selected winners happen to have wagered the maximum number of tokens and therefore won the entire jackpot, there would always be some remaining jackpot to add to the jackpot of the next drawing. In addition, the enrollment rule ensures continuous participation in the ongoing lottery drawings. As a result, the jackpot may quickly snowball into a large amount, further increasing players' interest in the game.

For business advantages, it may he preferable to set the maximum number of tokens that each player ID can contribute to each drawing at a relatively low value. For example, if the daily maximum that can be entered for a daily drawing is one dollar, a player can contribute as little as one cent but never more than one dollar. The player will not feel any significant financial impact or burden to continue playing the lottery game for many drawing days. By wagering the equivalent of pocket change on a daily basis, the player may still enjoy a decent chance of winning a substantial amount of money.

Figure 2:
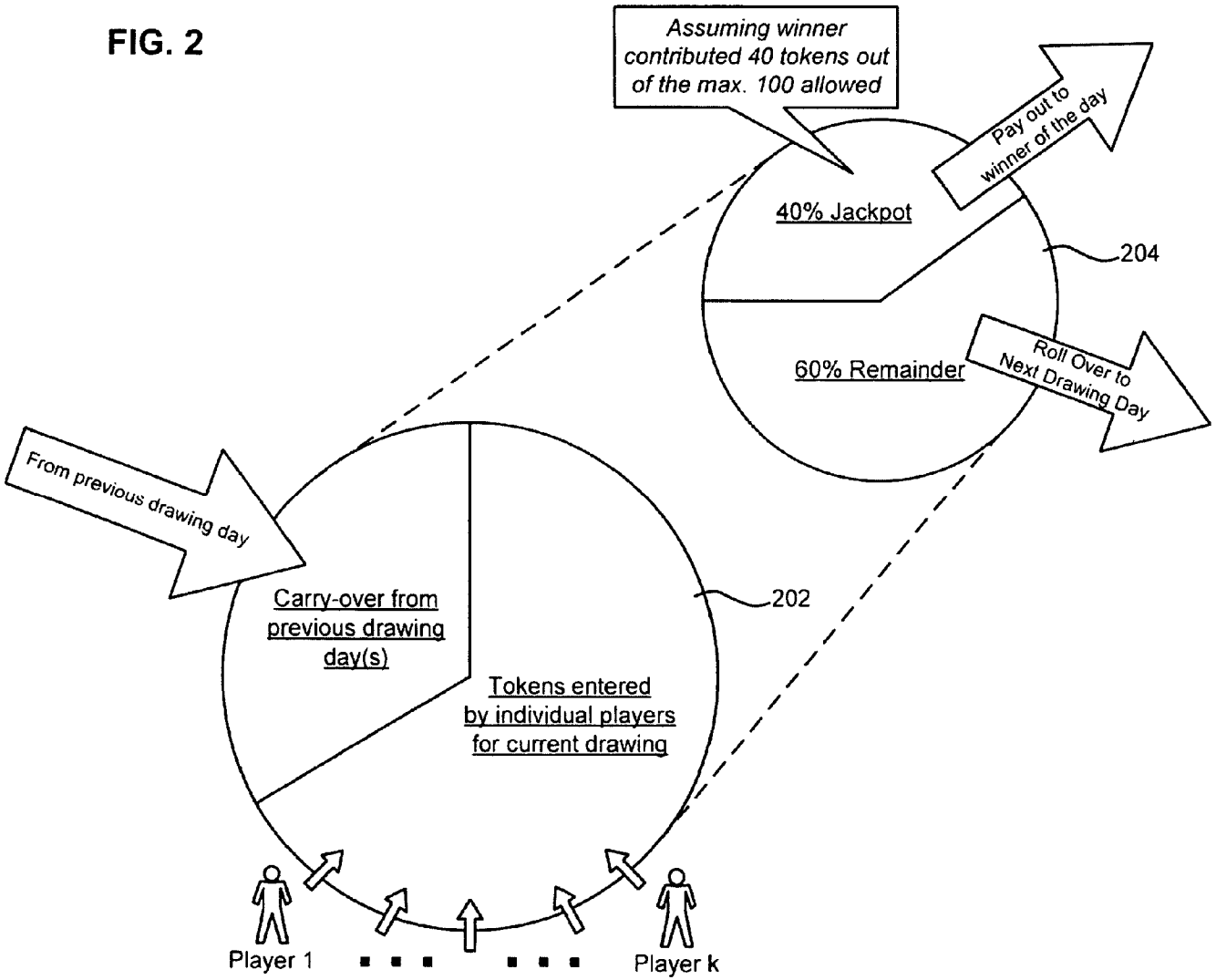
FIG. 2 illustrates the flow of tokens from the perspective of a lottery game operator in accordance with one embodiment of the present invention.

FIG. 2 illustrates the flow of tokens from the perspective of a lottery game operator in accordance with one embodiment of the present invention. For case of illustration, it will be assumed that lottery drawings in the lottery game occur on a daily basis. On each drawing day, a pie chart 202 represents a jackpot prize and sources thereof, whereas a pie chart 204 represents the same jackpot prize (but shown separately for clarity) and disbursement therefrom. The pie chart 202 indicates that a first portion of the present drawing day's jackpot include tokens carried over from one or more previous drawing days. The pie chart 202 also indicates that second portion of the jackpot include tokens contributed by individual players for the current drawing. The pie chart 204 indicates that at least a fraction of the jackpot prize may be paid out to a winner of the day. Assuming there is a single winner and that player contributed 40 tokens out of the maximum 100 allowed. 40% of the jackpot prize may be paid out to the winner. In that case, the remaining 60% of the jackpot may be rolled over to a next drawing day.

Figure 3:
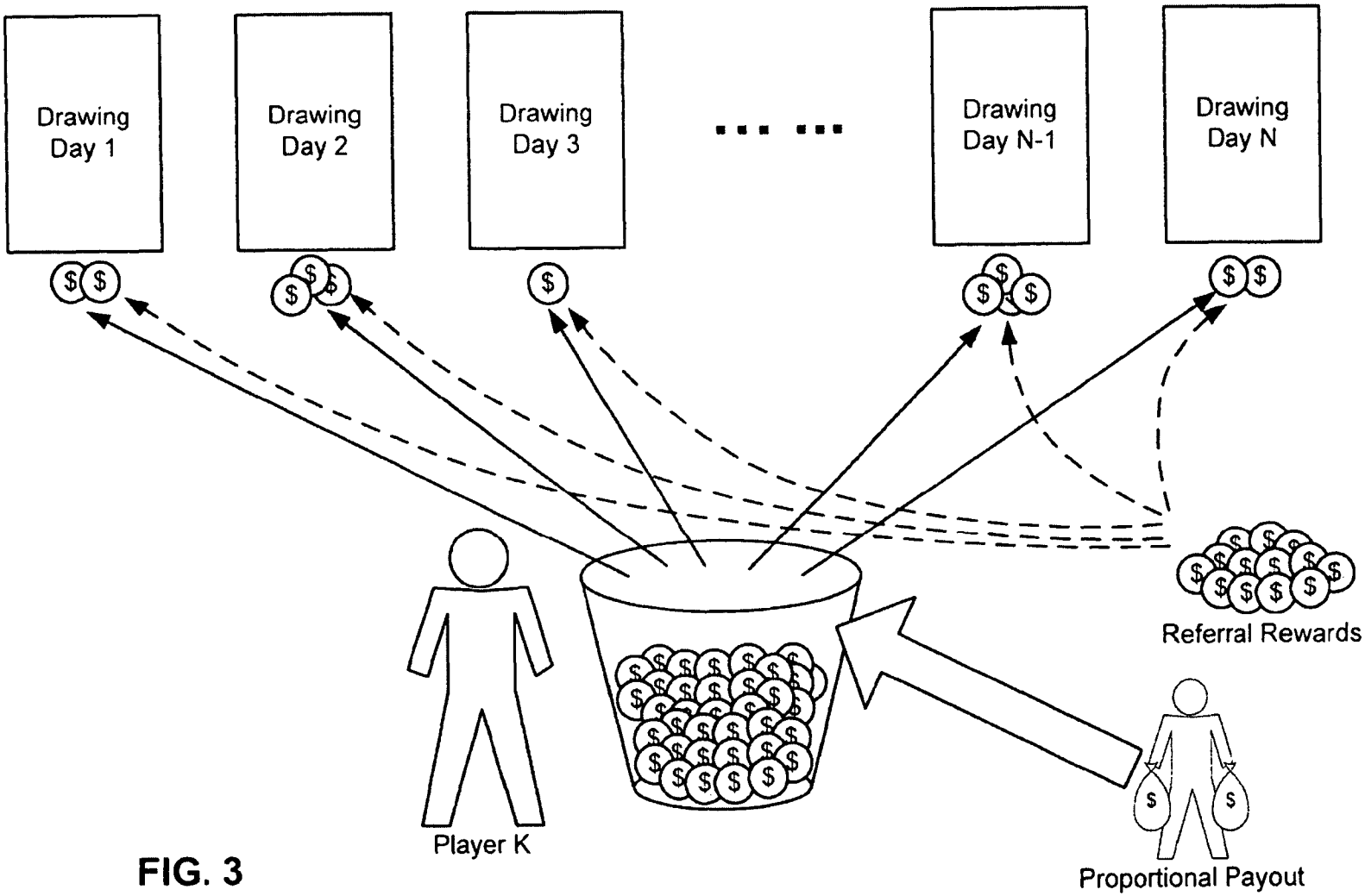
FIG. 3 illustrates the flow of tokens from the perspective of a player in a lottery game in accordance with one embodiment of the present invention.

FIG. 3 illustrates the flow of tokens from the perspective of a player in a lottery game in accordance with one embodiment of the present invention. The exemplary player, Player K, may he committed to participate in N lottery drawings occurring on N consecutive days, wherein N is an integer greater than one. The bucket of dollar-sign tokens represents an account balance for Player K. Player K may have started with a "full bucket" of tokens that were purchased upon enrollment. As described earlier, I-layer K may designate one or more tokens to be contributed to each daily drawing. The number of tokens designated may be constant or may vary day-to-day. As drawing days go by, unless Player K wins in one or more lottery drawings, Player K's account may be slowly depleted and may have to be replenished. If Player K happens to be picked as a winner in one of the drawings, the proportional payout from that drawing may also replenish Player K's account to some extent.

According to one embodiment of the present invention, Player K may also enjoy another source of tokens—referral rewards. In order to encourage Player K to refer additional players to join the lottery game, Player K may be awarded a number of tokens for each new player brought into the game. The referral rewards may be simply deposited into Player K's account. Alternatively, the referral rewards may be automatically entered into daily drawings on behalf of Player K and in addition to Player K's own contribution to the daily drawings. For example, for each new player that Player K received, one or more tokens may be added to Player K's daily wager amount. These additional tokens may be awarded to Player K as long as the newly referred player remains an active participant in the lottery drawings. Furthermore, the amount of referral rewards may be linked to activity level of the new player referred.

Figure 4:
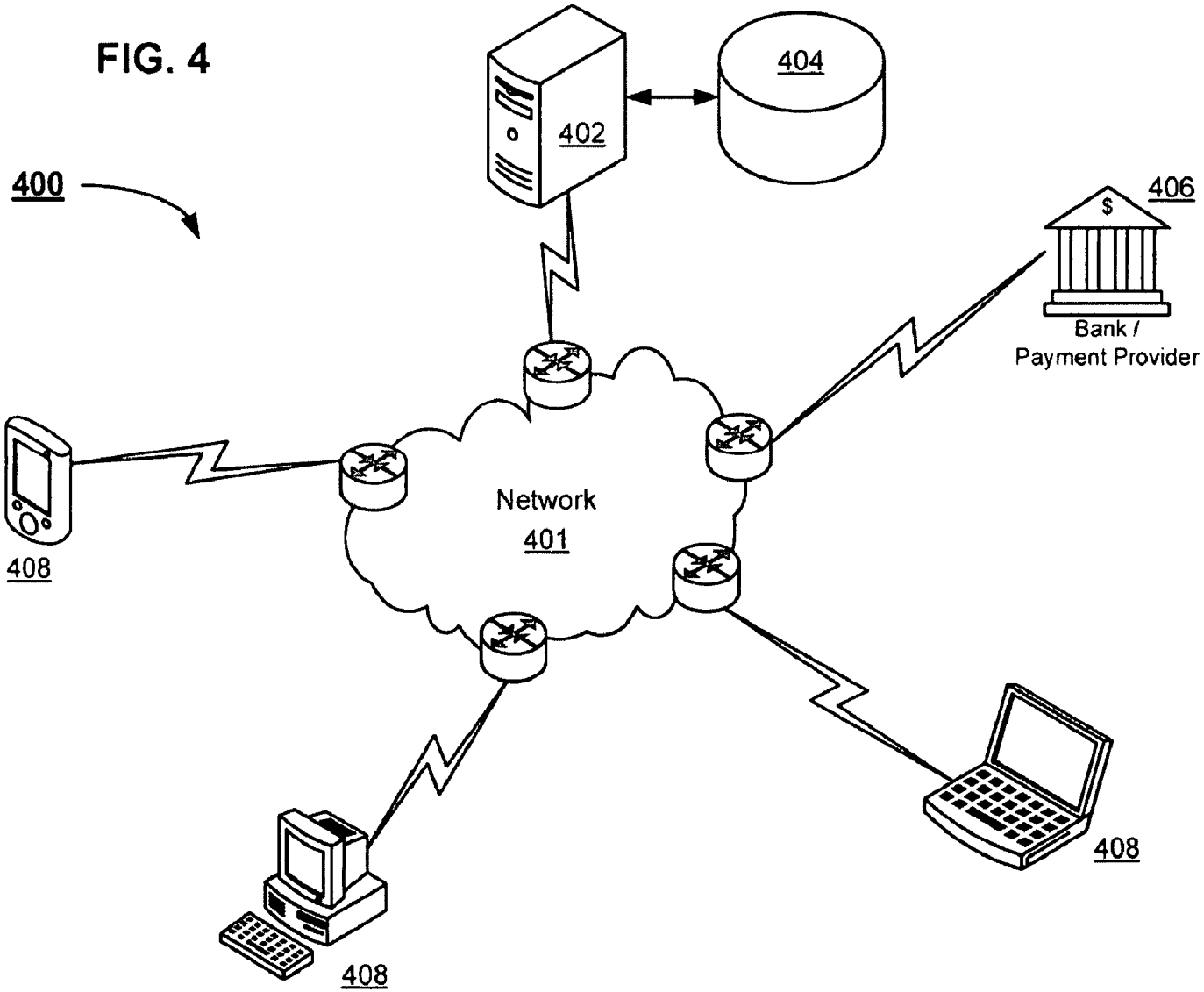
FIG. 4 is a block diagram illustrating an exemplary system for facilitating lottery-style games in accordance with one embodiment of the present invention.

FIG. 4 is a block diagram illustrating an exemplary system 400 for facilitating lottery-style games in accordance with one embodiment of the present invention.

The system 400 may be or include a computer system. This embodiment of the present invention may be described in the general context of computer-executable instructions, such as program modules, being executed by a computer. Generally, program modules include routines, programs, objects, components, data structures, etc. that perform particular tasks or implement particular abstract data types. A series of programmable instructions may be stored in a computer-readable medium performing the lottery-style gaming functions disclosed herein and to achieve technical effects in accordance with the disclosure. More exemplary software and data-storage modules will be described below in connection with FIG. 5.

The lottery-style games described herein may be entered into and/or played at one or more game terminals or kiosks on or near the premises of a casino, a department store, a shopping mall, or other suitable commercial sites. For example, potential participants in a lottery-style game might be limited by laws which prohibit online wagering with payment cards. It may be beneficial for those participants to visit, or have someone else visit on their behalf, a commercial outlet with above-mentioned game terminals or kiosks where they can lawfully register and/or play the lottery-style games. Once a player has registered and funded his/her membership, he/she may continue monitoring the daily progress of the game via Internet or other communication means. As needed, the player may occasionally re-visit the game terminals or kiosks to re-fill accounts associated with his/her player IDs.

Those skilled in the art will appreciate that the invention may be practiced with various computer system configurations, including hand-held wireless devices such as mobile phones or personal digital assistants (PDAs), multiprocessor systems, microprocessor-based or programmable consumer electronics, minicomputers, mainframe computers, and the like. The invention may also be practiced in distributed computing environments where tasks are performed by remote processing devices that are linked through a communications network. In a distributed computing environment, program modules may be located in both local and remote computer storage media including memory storage devices.

The computer system may include a general purpose computing device in the form of a computer including a processing unit, a system memory, and a system bus that couples various system components including the system memory to the processing unit.

Computers typically include a variety of computer readable media that can form part of the system memory and be read by the processing unit. By way of example, and not limitation, computer readable media may comprise computer storage media and communication media. The system memory may include computer storage media in the form of volatile and/or nonvolatile memory such as read only memory (ROM) and random access memory (RAM). A basic input/output system (BIOS), containing the basic routines that help to transfer information between elements, such as during start-up, is typically stored in ROM. RAM typically contains data and/or program modules that are immediately accessible to and/or presently being operated on by processing unit. The data or program modules may include an operating system, application programs, other program modules, and program data. The operating system may be or include a variety of operating systems such as Microsoft Windows® operating system, the Unix operating system, the Linux operating system, the Xenix operating system, the IBM AIX™ operating system, the Hewlett Packard UX™ operating system, the Novell Netware™ operating system, the Sun Microsystems Solaris™ operating system, the OS/2™ operating system, the BeOS™ operating system, the Macintosh™® operating system, the Apache™ operating system, an OpenStep™ operating system or another operating system of platform.

At a minimum, the memory includes at least one set of instructions that is either permanently or temporarily stored. The processor executes the instructions that are stored in order to process data. The set of instructions may include various instructions that perform a particular task or tasks, such as those shown in the appended flowcharts. Such a set of instructions for performing a particular task may be characterized as a program, software program, software, engine, module, component, mechanism, or tool. The system 400 may include a plurality of software processing modules stored in a memory as described above and executed on a processor in the manner described herein. The program modules may be in the form of any suitable programming language, which is converted to machine language or object code to allow the processor or processors to read the instructions. That is, written lines of programming code or source code, in a particular programming language, may be converted to machine language using a compiler, assembler, or interpreter. The machine language may be binary coded machine instructions specific to a particular computer.

Any suitable programming language may be used in accordance with the various embodiments of the invention. Illustratively, the programming language used may include assembly language, Ada, APL, Basic, C, C++, COBOL, dBase, Forth, FORTRAN, Java, Modula-2, Pascal, Prolog, REXX, and/or JavaScript, for example. Further, it is not necessary that a single type of instruction or programming language be utilized in conjunction with the operation of the system and method of the invention. Rather, any number of different programming languages may be utilized as is necessary or desirable.

Also, the instructions and/or data used in the practice of the invention may utilize any compression or encryption technique or algorithm, as may be desired. An encryption module might be used to encrypt data. Further, files or other data may be decrypted using a suitable decryption module.

The computing environment may also include other removable/non-removable, volatile/nonvolatile computer storage media. For example, a hard disk drive may read or write to non-removable, nonvolatile magnetic media. A magnetic disk drive may read from or writes to a removable, nonvolatile magnetic disk, and an optical disk drive may read from or write to a removable, nonvolatile optical disk such as a CD-ROM or other optical media. Other removable/non-removable, volatile/nonvolatile computer storage media that can be used in the exemplary operating environment include, but are not limited to, magnetic tape cassettes, flash memory cards, digital versatile disks, digital video tape, solid state RAM, solid state ROM, and the like. The storage media are typically connected to the system bus through a removable or non-removable memory interface.

The processing unit that executes commands and instructions may be a general purpose computer, but may utilize any of a wide variety of other technologies including a special purpose computer, a microcomputer, mini-computer, mainframe computer, programmed micro-processor, micro-controller, peripheral integrated circuit element, a CSIC (Customer Specific Integrated Circuit), ASIC (Application Specific Integrated Circuit), a logic circuit, a digital signal processor, a programmable logic device such as an FPGA (Field Programmable Gate Array), PLD (Programmable Logic Device), PLA (Programmable Logic Array), RFID integrated circuits, smart chip, or any other device or arrangement of devices that is capable of implementing the steps of the processes of the invention.

It should be appreciated that the processors and/or memories of the computer system need not be physically in the same location. Each of the processors and each of the memories used by the computer system may be in geographically distinct locations and be connected so as to communicate with each other in any suitable manner. Additionally, it is appreciated that each of the processor and/or memory may be composed of different physical pieces of equipment.

A user may enter commands and information into the computer through a user interface that includes input devices such as a keyboard and pointing device, commonly referred to as a mouse, trackball or touch pad. Other input devices may include a microphone, joystick, game pad, satellite dish, scanner, voice recognition device, keyboard, touch screen, toggle switch, pushbutton, or the like. These and other input devices are often connected to the processing unit through a user input interface that is coupled to the system bus, but may be connected by other interface and bus structures, such as a parallel port, game port or a universal serial bus (USB).

One or more monitors or display devices may also be connected to the system bus via an interface. In addition to display devices computers may also include other peripheral output devices, which may be connected through an output peripheral interface. The computers implementing the invention may operate in a networked environment using logical connections to one or more remote computers, the remote computers typically including many or all of the elements described above.

Various networks may be implemented in accordance with embodiments of the invention, including a wired or wireless local area network (LAN) and a wide area network (WAN), wireless personal area network (PAN) and other types of networks. When used in a LAN networking environment, computers may be connected to the LAN through a network interlace or adapter. When used in a WAN networking environment, computers typically include a modem or other communication mechanism. Modems may be internal or external, and may be connected to the system bus via the user-input interface, or other appropriate mechanism. Computers may be connected over the Internet, an Intranet, Extranet, Ethernet, or any other system that provides communications. Some suitable communications protocols may include TCP/IP, UDP, or OSI for example. For wireless communications, communications protocols may include Bluetooth, Zigbee, IrDa or other suitable protocol. Furthermore, components of the system may communicate through a combination of wired or wireless paths.

Although many other internal components of the computer are not shown, those of ordinary skill in the art will appreciate that such components and the interconnections are well known. Accordingly, additional details concerning the internal construction of the computer need not be disclosed in connection with the present invention.

More specifically, the system 400 may comprise at least one gaming server 402 coupled to one or more databases 404 and/or other data sources. The gaming server 402 may run a plurality of software modules to facilitate lottery-style games in accordance with embodiments of the present invention. The database(s) 404 may hold data records related to players and lottery drawings. One additional data source may be a bank or payment provider (406) that performs payment and/or credit services for the lottery game operator and players. Via a network 401, the players may communicate, locally or remotely, with the gaming server 402 in order to enroll in the lottery game, participate in drawings, and manage player accounts. The players may employ a variety of computing devices 408 such as personal computers, mobile computers, personal digital assistants or handheld devices for communication with the gaming server 402.

Figure 5:
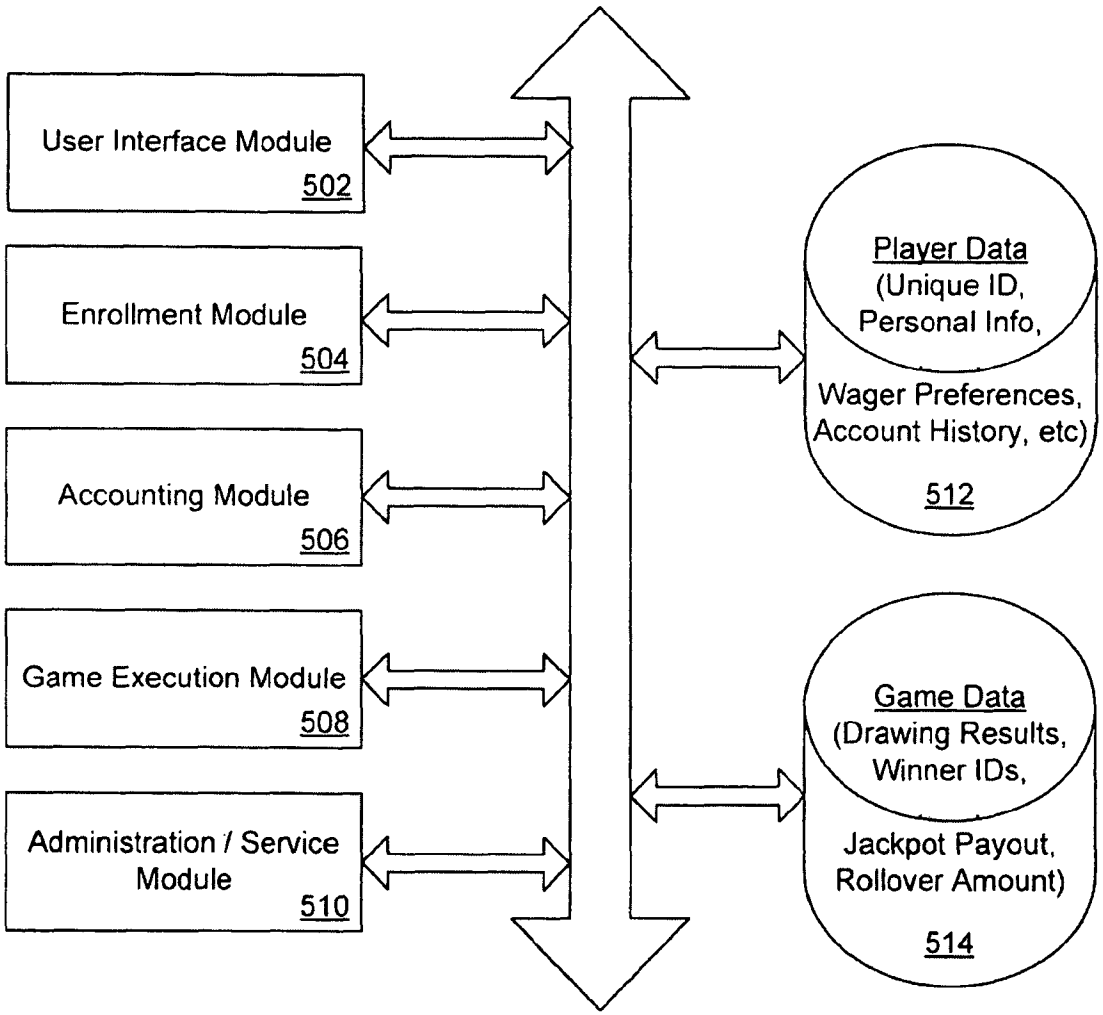
FIG. 5 is a block diagram illustrating exemplary software and data-storage modules for facilitating lottery-style games in accordance with one embodiment of the present invention.

FIG. 5 is a block diagram illustrating exemplary software and data-storage modules for facilitating lottery-style games in accordance with one embodiment of the present invention. The exemplary modules may include a user interface module 502, an enrollment module 504, an accounting module 506, a game execution module 508, an administration/service module 510, a player data module 512, and a game data module 514. These software modules may be programmed or configured to communicate with one another or with the data-storage modules.

The user interface module 502 may provide computer and/or Internet access for players and game operators/administrators to communicate with the other software modules. The enrollment module 504 may perform functions related to registering new players, such as verifying player information, assigning player IDs, and creating player records. The accounting module 506 may be responsible for managing player accounts and handling debit and credit transactions against the player accounts, including daily wagering and winner payouts. The game execution modules may perform functions such as scheduling and conducting lottery drawings, generating and publishing drawing results, and calculating proportional values and payout amounts. The administration/service module 510 may facilitate administrative and customer service tasks to be performed by an operator or personnel of the lottery game system.

The player data module 512 may contain and manage data records related to each player, such as player ID, personal information, wager preferences, account history, and so on. The game data module 514 may contain and manage data records related to the lottery drawings, such as drawing results, winner IDs, jackpot payouts, and roller amounts.

As variations of and/or improvement upon the above-described lottery-style games, other embodiments of the present invention may otter similar, membership-based games in connection with virtual and/or real maps. This type of lottery-style games may be referred to and are intended to be marketed or promoted as GeoSweep™ games. In a typical GeoSweep™ game, a grid pattern may be overlaid over a map dividing a land into grid units. A player may enroll in the game by taking virtual land ownership of one or more grid units and becoming committed to participate, in a series of scheduled lottery drawings. The player may participate in a drawing by contributing tokens of value on behalf of at least one grid unit the player owns. During any of those drawings, if a grid unit owned by the player is selected as a (first-prize) winner, that player may receive a full or proportional prize amount. Additional winners in that drawing may be selected to win lesser amounts than the first-prize winner. Those additional winners are selected and their payout amounts are determined based on map positions of the additional winners with respect to the first-prize winner.

Figure 6:
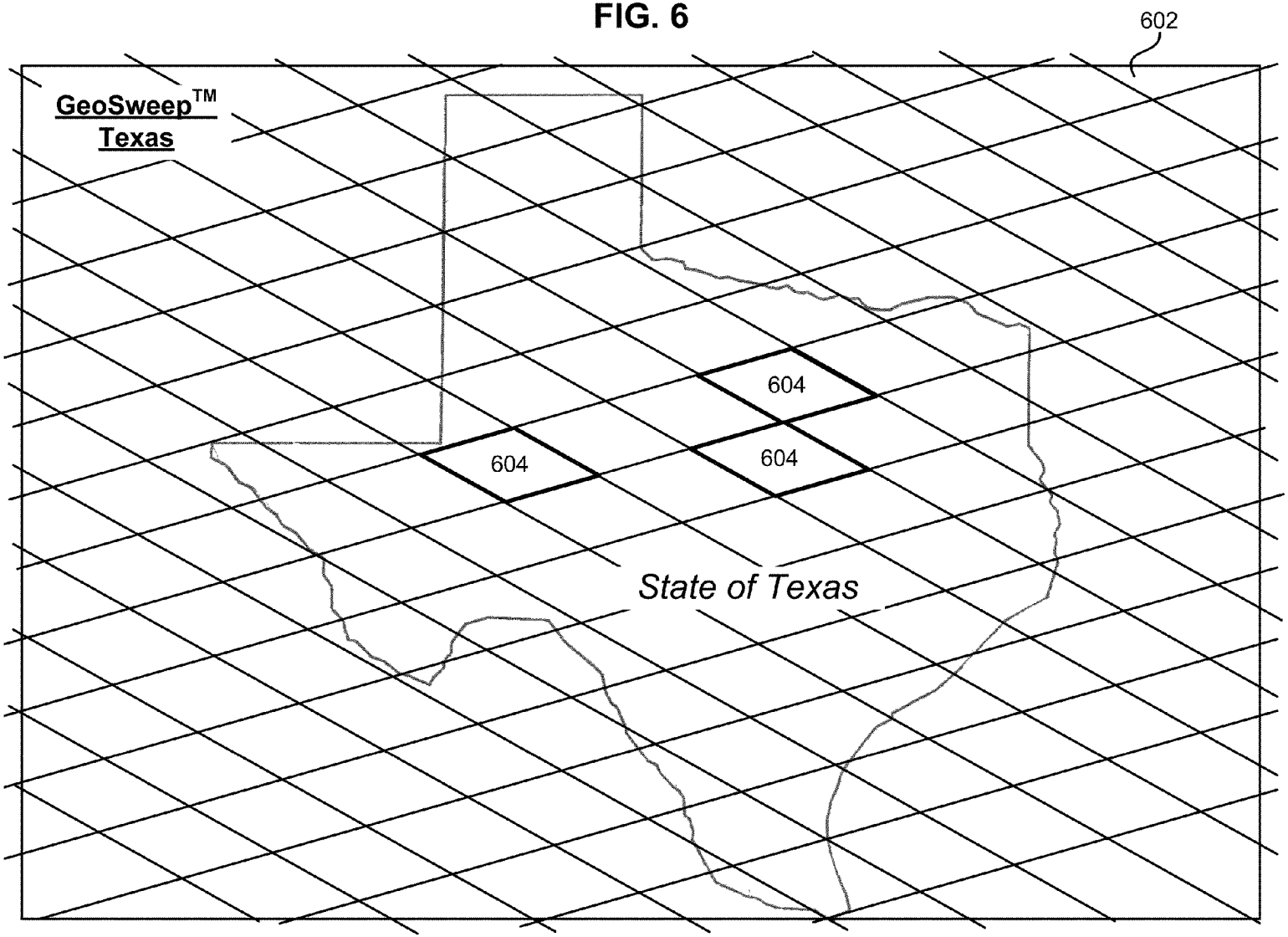
FIG. 6 shows a grid map for an exemplary GeoSweep game in accordance with one embodiment of the present invention.

FIG. 6 shows a grid map for an exemplary GeoSweep game in accordance with one embodiment of the present invention. The game may be referred to as "GeoSweep Texas," wherein a map of the State of Texas is overlaid with a grid 602. Each grid unit 604 may be a rectangle or a square of the same or similar size. In general, a grid unit can take any other shape, such as triangle, hexagon (honeycomb) or other polygon. In some GeoSweep games, the grid units can have different shapes and/or sizes without substantially affecting the operation of the games. As a result, the grid 602 may divide up land of Texas into a plurality of small parcels with well defined boundaries. Each of the parcels (or grid units 604) may be uniquely identified.

To participate in the GeoSweep Texas game, a player may be required to register to become a member. During registration, the player may pick one or more of available parcels to become a virtual owner thereof. There may or may not be an upfront cost for "owning" a parcel. Both sole and shared ownership may be possible for a parcel. In some instances, it might be beneficial to hold an auction among multiple interested players to determine which player gets a popular parcel. In addition, the player may make a commitment to participate in a plurality of scheduled lottery-style drawings involving the one or more parcels. The plurality of scheduled lottery-style drawings may take place periodically, such as once or more times a day, every other day or every few days, or a number of times per week or month. In each drawing, each participating parcel may be required to contribute a predetermined number of tokens to a prize pool or jackpot. The predetermined number may be a fixed one set by the game operator or administrator, or, alternatively, a variable one to be designated by each individual owner of the participating parcels. In any case, upon registration, each player may be required to fund his or her commitment to participate in drawings by depositing or pledging some amount of money.

At each drawing, one or more parcels or grid units 604 may be randomly selected as sole winner(s) or first-prize winner(s). For ease of explanation, it is assumed hereinafter that each drawing selects a single grid unit as a sole winner or a first-prize winner. In the case of a sole winner, an entire amount of jackpot or a calculated fraction thereof may be awarded to the owner of that winning grid unit. More typically, in addition to a first-prize winner, one or more winners of lesser amounts may be determined based on their relative map positions with respect to the first-prize winner. According to some embodiments, the drawing may be limited to parcels that are already owned or claimed by participating players, thereby ensuring at least one player will be entitled to a prize as described in more detail below. According to some embodiments of the present invention, the parcels or grid units may each have the same chance of being drawn as a first-prize winner. According to other embodiments, the parcels or grid units may have varying chances of being picked as a winner. For example, when a parcel costs more to own than others, it might enjoy a better chance of winning.

The prizes in each drawing may comprise tokens of value which have been contributed to that drawing by participating parcels. The prizes may also comprise rollover prizes from a previous drawing. In addition or as an alternative, the prizes may comprise other things of value. For example, a marketing partnership may be formed between the game operator and other business entities. In return for promotional or advertising activities on the GeoSweep game platform, the business partners may contribute products and services to be awarded as prizes. If justified by the cost or return on investment, an actual piece of land or other real property may be awarded to a first-prize winner or a sole jackpot winner.

Figure 7A:
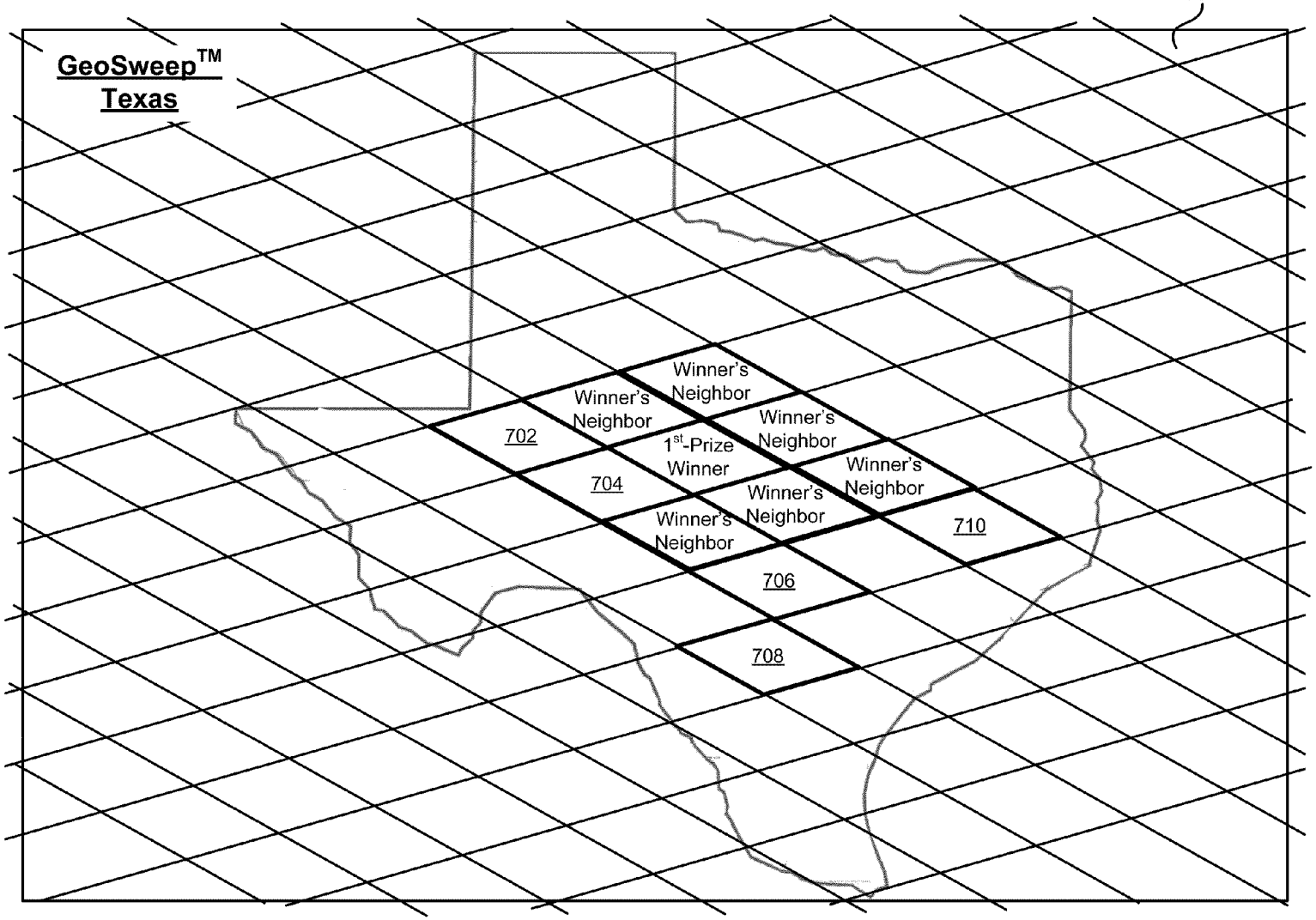
FIGS. 7A-B illustrate an exemplary payout structure in an exemplary GeoSweep game in accordance with one embodiment of the present invention.
Figure 7B:
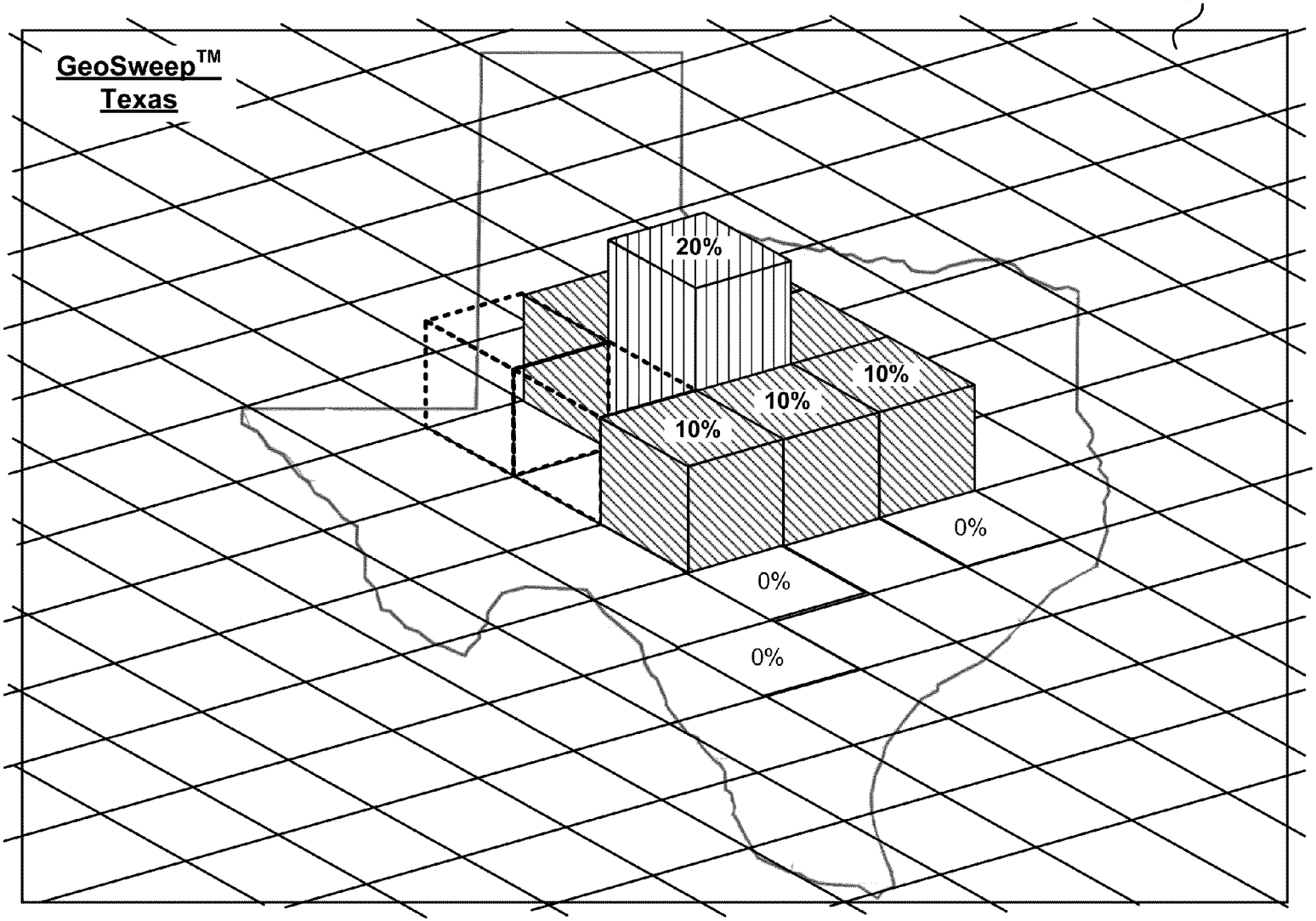

FIGS. 7A-B illustrate an exemplary payout structure for the GeoSweep Texas game described above.

FIG. 7A shows one grid unit that has been selected as a first-prize winner. That first-prize winning grid unit has eight neighboring grid units among which six are owned by participating players while the other two (702 and 704) are not owned by any player. Grid units 706, 708 and 710, which are owned by some players, do not share any common boundary with the grid unit selected for the first prize.

Referring to FIG. 7B, the first-prize winning grid unit may be allocated a prize amount that equals 20% of the jackpot available for that drawing. The eight grid units which happen to be the winner's neighbors may each be allocated 10% of the jackpot. Thus, were all eight grid units of the winner's neighbors owned by participating players, the entire jackpot would have been disbursed among owners of the nine parcels (i.e., 1×20%+8×10%=100%). However, since two of the winner's neighbors (702 and 704) are not occupied or owned by any player, the two 10% shares (i.e., 20% of jackpot) that would have been allocated to owners of grid units 702 and 704 may now be deemed not won by anyone and can be rolled over to the next drawing. The grid units 706, 708 and 710, which are further away from the first-prize winning grid unit than the winner's neighbors, do not win anything in this round of drawing.

According to one embodiment of the present invention, the GeoSweep game may include mechanisms to encourage player referrals. For example, in a GeoSweep Texas game where Texas is divided into 20 million parcels, a player owning 20 parcels may be gifted an additional unit for every new player that he or she refers. Each parcel has an equal chance of winning the first prize. Thus, the effect of the referral reward may be somewhat different from that in a proportional lottery-style game described earlier. In a lottery-style game, the referral reward has the effect of increasing the proportion of the prize that a referring player would win. Here, in a GeoSweep game, the referral reward has the effect of increasing the chance of winning.

According to another embodiment of the present invention, the GeoSweep game may also have a proportional lottery aspect to it. In that case, at or shortly after registration, a player in the GeoSweep Texas game may specify how many tokens to be entered for drawings on behalf of a parcel the player owns. The number of tokens entered for each drawing and on behalf of each parcel may be within a predetermined range, for example, between 1 and 100 inclusive. In a drawing, if a parcel is selected as a first-prize winner, then a proportional value may be calculated based on the number of tokens that have been entered on behalf of that parcel. For instance, if 100 is the maximum number of tokens that can be entered for each parcel and 45 tokens are actually entered on behalf of the first-prize winning parcel, then the proportional value is calculated to be 45% (i.e., 45/100). Next, that proportional value may be applied to whatever payout structure is applicable, such that the owner of the first-prize winning parcel will only be awarded a fraction (e.g., 45%) of the full first-prize amount. According to some embodiments, owners of the winner's neighboring parcels may be subject to the same proportional value applied to the first-prize winner. Alternatively, according to some other embodiments, the payout to a winier's neighboring parcel may be subject to a different proportional value calculated based on the number of tokens contributed on behalf of that particular parcel. Therefore, the above-described map-based payout structure may be used to determine full prize amounts for the winner's neighbors, whereupon such full prize amounts may be reduced according to the individual proportional values calculated for each of those parcels.

It should be appreciated that the above description of the GeoSweep Texas game is exemplary only. Numerous variations or modifications may be applied to that exemplary game, such as payout structure, grid geometry, and map subject.

Figure 8:
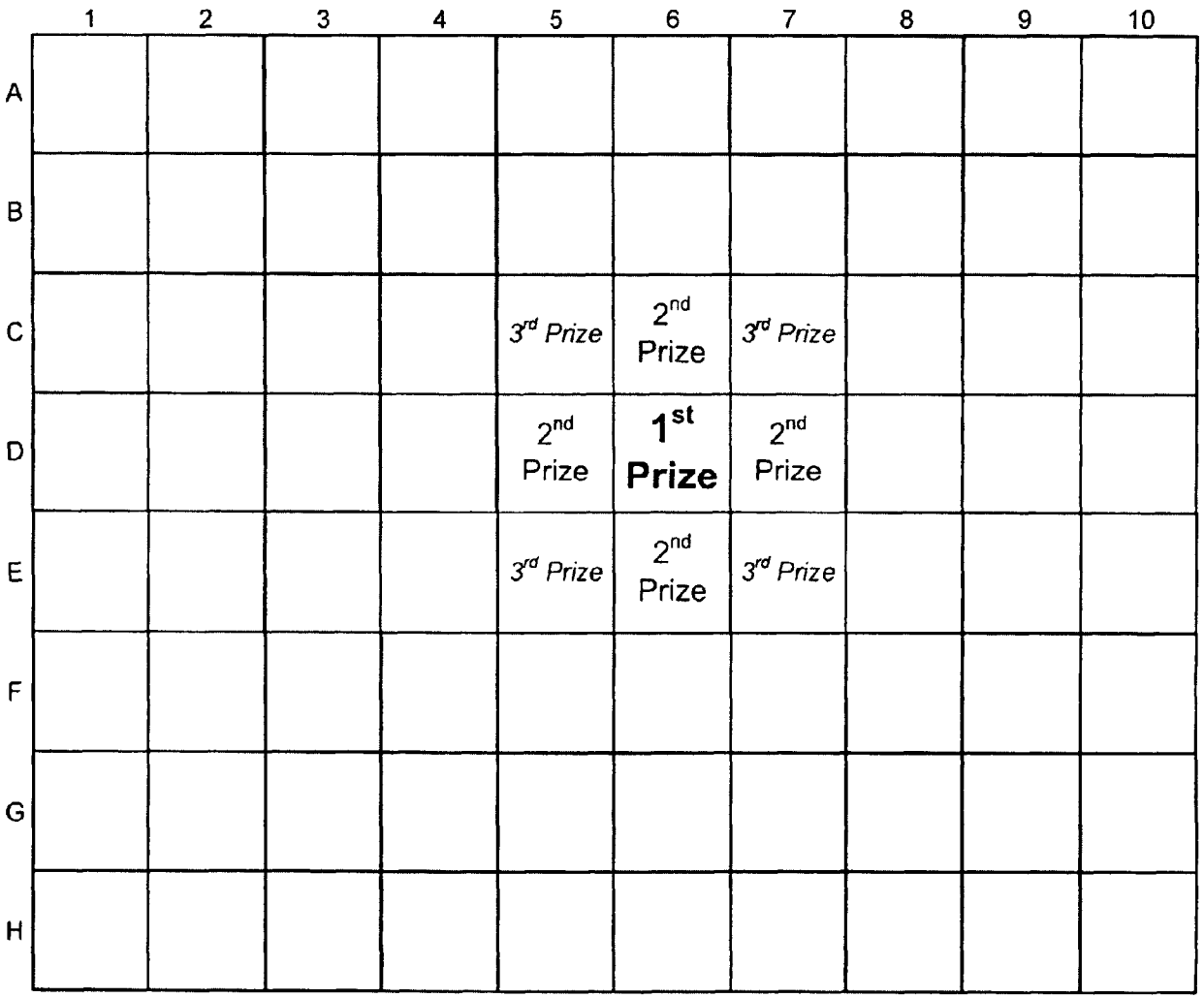
FIG. 8 illustrates an alternative payout structure in an exemplary GeoSweep game in accordance with one embodiment of the present invention.

FIG. 8 illustrates an alternative payout structure in an exemplary GeoSweep™ game in accordance with one embodiment of the present invention. In a grid with rectangular or square shaped units, cell D-6 may be selected as a first-prize winner during a drawing. Then, four closest neighbors of cell D-6 (i.e., D-5, D-7, C-6, and E-6), each of which shares one side with cell D-6, may become entitled to second prizes. Four other neighbors of cell D-6 (i.e., C-5, C-7, E-5, and E-7), each of which shares only one node with cell D-6, may be entitled to third prizes. The third prizes may be of a lesser amount than the second prizes, and the second prizes of a lesser amount than the first prize. For example, the third prizes may each be 5% of a jackpot amount, the second prizes may each be 10% of the jackpot amount, and the first prize may be 40% of the jackpot amount. According to another embodiment, the first prize may be 60% of the jackpot, the second prizes may share 30% (i.e., 7.5% each), and the third prizes may share the remaining 10% (i.e., 2.5% each).

FIG. 9 illustrates another alternative payout structure in an exemplary GeoSweep game in accordance with one embodiment of the present invention. In this embodiment, cell D-6 is again selected as a single first-prize winner. The eight neighbors of cell D-6 may become winners of second prizes. Further away from cell D-6, the sixteen next closest neighbors of cell D-6 may be winners of third prizes. For example, the first prize may be 68% of a jackpot, the second prizes may share 16% of the jackpot (i.e., 2% each), and the third prizes may share 16% of the jackpot (i.e., 1% each). According to other embodiments, additional "rings" of neighbors may be included as winners of even lesser prizes.

According to some embodiments of the present invention, two or more grid units may be selected as first-prize winners. A set of rules may be established to determine which other grid units qualify as second-prize winners, third-prize winners, and so on. For example, grid units which are immediate neighbors of the selected first-prize winners may win second prizes. Then, if the first-prize winning grid units are far apart from one another, there may be multiple pockets or clusters of prize winners, each pocket or cluster being centered around one first-prize winner.

Figure 10:
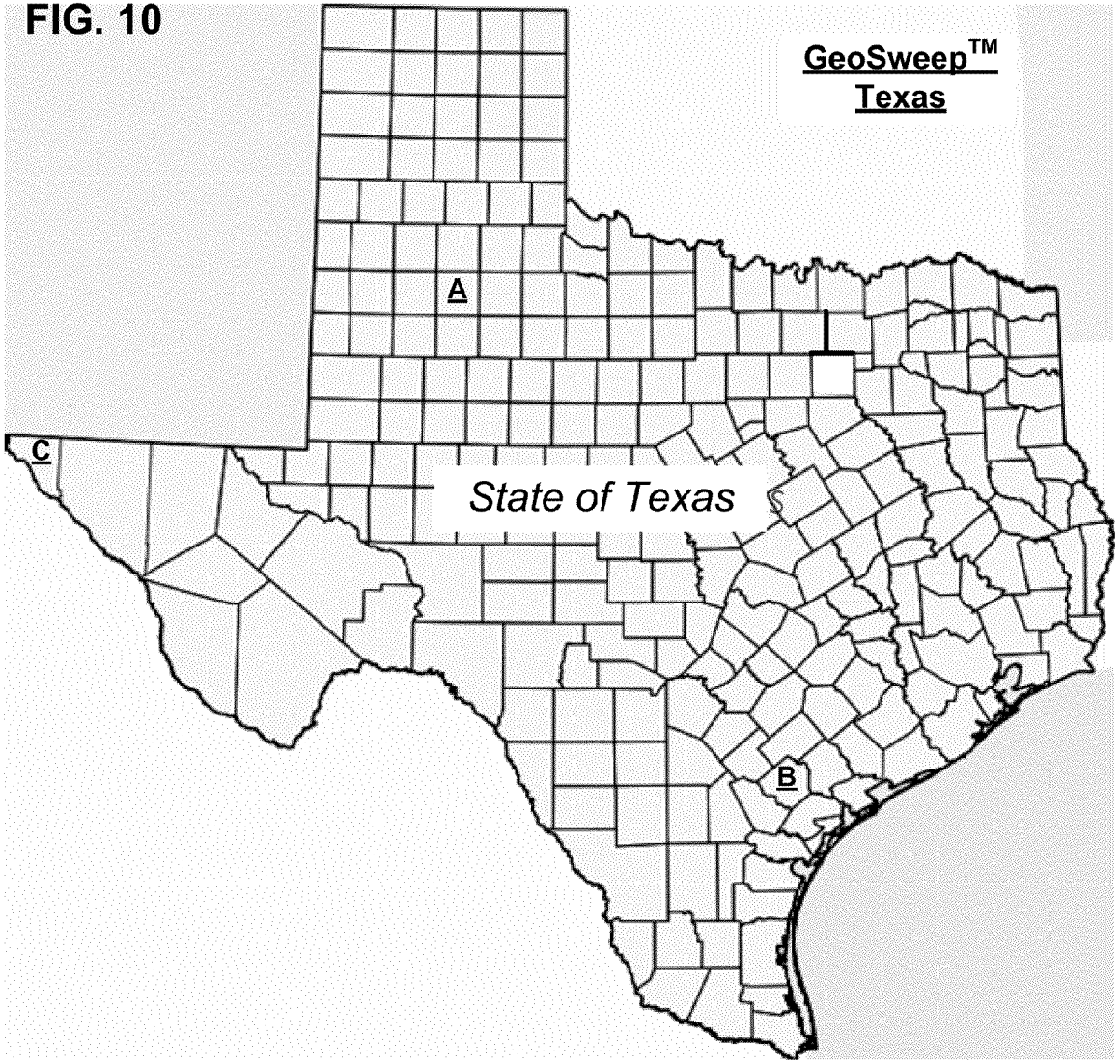
FIG. 10 illustrates an alternative method of establishing a grid or land boundaries in an exemplary GeoSweep game in accordance with one embodiment of the present invention.

FIG. 10 illustrates an alternative method of establishing a grid or land boundaries in an exemplary GeoSweep game in accordance with one embodiment of the present invention. In this version of the GeoSweep Texas game, rather than overlaying a uniform grid over the Texas map, actual boundaries among the Texas counties may help define grid units of various sizes and shapes. Alternatively, actual land boundaries may define grid units for the GeoSweep game, such that the GeoSweep grid units correspond to actual land parcels. According to one embodiment, every grid unit (e.g., county or smaller parcels) may still cost exactly the same to "own" and/or have the same chance of being selected as a winner. According to another embodiment, the grid units or counties may cost differently and/or have varying chances of winning based on size and popularity of each county or parcel. In some embodiments, game parameters associated with a parcel on the GeoSweep map may be correlated to or associated with the conditions, market value, and popularity of the corresponding piece of land in the real world.

Since the grid units are irregularly shaped and in a non-uniform grid, different grid units may have different number of neighbors. For example, County A has eight neighboring counties, County B has live, and County C has only one. Depending on which grid unit is selected as a first-prize winner, there may be at least one but up to eight immediate neighbors who may be entitled to a second prize. One solution is to designate a fixed percentage of the jackpot that each second-prize winner is entitled to. For example, if each second-prize winner takes 2% of the jackpot, then 9 neighbors of the first-prize winner will share 18% of the jackpot while 2 neighbors (it there are only two) will only take 4% of the jackpot. Alternatively, a fixed percentage of the jackpot may be shared among the second-prize winners regardless of how many second-prize winners there may be. In that case, it a first-prize winner has only one neighbor, such as the case of County C, that single neighbor will be the sole second-prize winner taking the entire amount that has been allocated to second prizes. If the first-prize winner has eight neighbors, such as the case of County A, the eight neighbors will each take ⅛ of the entire amount that has been allocated to second prizes.

Many variations of prize-sharing schemes may be implemented for GeoSweep and/or proportional lottery-style games. In one embodiment, players that were introduced to the game by an existing player may share some of their winnings with that original (referring) player. In a further embodiment, groups of players may form prize-sharing clusters or syndicates.

Although a map of the State of Texas is used above as an example, it should be appreciated that maps of other types of geographic regions (e.g., township, city county country, ocean, island, and continent) may also be appropriate in GeoSweep games in accordance with embodiments of the present invention. For example, there may be GeoSweep USA, GeoSweep Europe, GeoSweep London, GeoSweep Hawaii, and so forth. In fact, a GeoSweep game may be established for a tourist destination and help promote tourism by offering prizes related to that destination or portions thereof. For example, a GeoSweep Alaska game may older free roundtrip airline tickets as or in addition to a first prize. The game may also offer free hotel accommodation in hotels that happen to be located within a winning grid unit. Since the GeoSweep games are map-based and/or location-specific, promotional opportunities and variations are almost endless, as will be appreciated by those of ordinary skill in the art of advertising and marketing.

Figure 11:
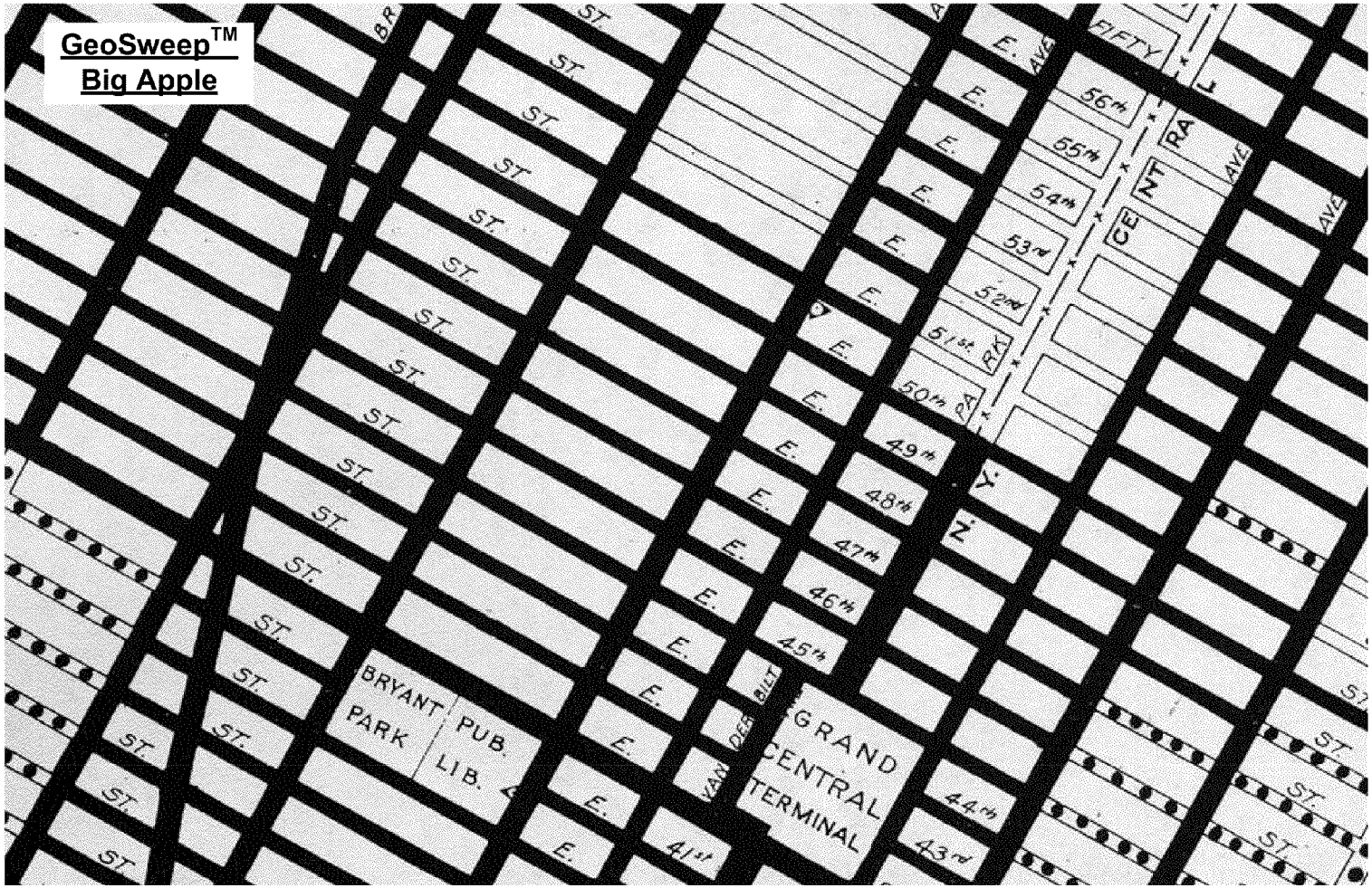
FIG. 11 illustrates another alternative method of establishing a grid or land boundaries in an exemplary GeoSweep game in accordance with one embodiment of the present invention.

FIG. 11 illustrates part of a New York City map to be used in an exemplary game which may be referred to as "GeoSweep Big Apple." As shown, the actual streets and avenues in mid-town Manhattan may serve to define grid units for the GeoSweep game. Local residents, business entities, and/or tourists may be encouraged to participate in this game. Each potential group of players may be offered different incentives. A local resident may be interested in virtual ownership of a street block that he or she actually lives on, and participation in the GeoSweep game may also be a social networking opportunity with other community members. A local business might be interested in sponsoring promotions and placing its name on the GeoSweep map. In fact, the GeoSweep map may be an online, interactive map with promotional and informational features. A tourist may also be interested in the game for various reasons, such as to get familiar with the area and to win travel-related prizes offered by local businesses.

While the foregoing description includes many details and specificities, it is to be understood that these have been included for purposes of explanation only, and are not to be interpreted as limitations of tie present invention. It will be apparent to those skilled in the art that other modifications to the embodiments described above can be made without departing from the spirit and scope of the invention. Accordingly, such modifications are considered within the scope of the invention as intended to be encompassed by the following claims and their legal equivalents.

The invention claimed is:

1. A computer-implemented method for lottery-style games, the method comprising using at least one processor and at least one storage medium for performing the following:

establishing a map-based game that is scheduled to have a number of lottery drawings associated with a map of a geographical area comprising a plurality of grid units wherein each grid unit represents a geographic location in the mapped geographical area, the map and grid units being stored as digital data at least part of which are capable of visual display via a graphical interface;

causing a personal computing device to display at least a portion of the map to a player, thereby accepting enrollment of a plurality of players in the map-based game;

receiving from each player a selection of at least one geographic location of interest corresponding to at least one grid unit on the map and a commitment to participate in a plurality of the lottery drawings by contributing tokens of value on behalf of the selected at least one grid unit;

receiving, from each player, a designated number of tokens to be contributed, on behalf of each of the at least one grid unit, to each of the plurality of the lottery drawings said player is committed to participate in; and executing the map-based game by doing the following for each lottery drawing:

pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize.

2. The method according to claim 1, wherein each player has virtual ownership of the at least one grid unit on the map.

3. The method according to claim 1, further comprising:

selecting one or more second grid units to win lesser prizes, the selection being based on relative map positions of the one or more second grid units with respect to the at least one first grid unit.

4. The method according to claim 3, wherein the one or more second grid units comprise grid units that are neighbors of the at least one first grid unit.

5. The method according to claim 1, wherein the designated number of tokens contributed, on behalf of each of the at least one grid unit is at least one and up to a predetermined maximum, and the method further comprising, in each lottery drawing:

calculating, for each of the at least one first grid unit and the one or more second grid units, a proportional value based on: (a) the number of tokens contributed on behalf of said grid unit to said lottery drawing, and (b) the predetermined maximum, and providing a fraction of the jackpot to the selected at least one winner based on the calculated proportional value.

6. The method according to claim 1, wherein the plurality of grid units are of a same size and shape.

7. The method according to claim 1, wherein at least one of the plurality of grid units is of a size or shape that is different from at least another grid unit.

8. The method according to claim 1, wherein the plurality of grid units have equal chance of being selected as a winner.

9. The method according to claim 1, wherein at least one of the plurality of grid units has a chance of winning that is different from at least another grid unit.

10. The method according to claim 1, further comprising:

rewarding an existing player for an referral of a new player who enrolls in the map-based game.

11. The method according to claim 10, wherein the existing player is awarded one or more grid units.

12. The method according to claim 11, wherein the one or more awarded grid units are automatically entered into the lottery drawing on behalf of the existing player.

13. A system for lottery-style games, the system comprising:

a processor;

at least one storage device coupled to the processor;

a user interface coupled to the processor via one or more communication networks;

wherein the processor is adapted to communicate with the at least one storage device and the user interface to execute instructions to perform the following tasks:

establishing a map-based game that is scheduled to have a number of lottery drawings associated with a map of a geographical area comprising a plurality of grid units wherein each grid unit represents a geographic location in the mapped geographical area, the map and grid units being stored as digital data at least part of which are capable of visual display via a graphical interface;

causing a personal computing device to display at least a portion of the map to a player, thereby accepting enrollment of a plurality of players in the map-based game, receiving from each player a selection of at least one geographic location of interest corresponding to at least one grid unit on the map and a commitment to participate in a plurality of the lottery drawings by contributing tokens of value on behalf of the selected at least one grid unit;

receiving, from each player, a designated number of tokens to be contributed, on behalf of each of the at least one grid unit, to each of the plurality of the lottery drawings said player is committed to participate in; and executing the map-based game by doing the following for each lottery drawing:

pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize.

14. The system according to claim 13, wherein each player has virtual ownership of the at least one grid unit on the map.

15. The system according to claim 13, being further configured to:

select one or more second grid units to win lesser prizes, the selection being based on relative map positions of the one or more second grid units with respect to the at least one first grid unit.

16. The system according to claim 15, wherein the one or more second grid units comprise grid units that are neighbors of the at least one first grid unit.

17. The system according to claim 13, wherein the designated number of tokens contributed, on behalf of each of the at least one grid unit is at least one and up to a predetermined maximum, and the system being further configured to, in each lottery drawing:

calculate, for each of the at least one first grid unit and the one or more second grid units, a proportional value based on: (a) the number of tokens contributed on behalf of said grid unit to said lottery drawing, and (b) the predetermined maximum, and provide a fraction of the jackpot to the selected at least one winner based on the calculated proportional value.

18. The system according to claim 13, wherein the plurality of grid units are of a same size and shape.

19. The system according to claim 13, wherein at least one of the plurality of grid units is of a size or shape that is different from at least another grid unit.

20. The system according to claim 13, wherein the plurality of grid units have equal chance of being selected as a winner.

21. A computer-implemented method for lottery-style games, the method comprising using at least one processor and at least one storage medium for performing the following:

establishing a map-based game that is scheduled to have a number of lottery drawings associated with a plurality of grid units on a map of a geographical area, wherein each grid unit represents a unique subset of the mapped geographical area;

storing the map and grid units as digital data at least part of which are configured for visual display via a graphical interface;

causing a personal computing device to display at least a portion of the map to a player, and thereby accepting enrollment of a plurality of players in the map-based game, wherein each player is uniquely associated with at least one grid unit on the map and is committed to participate in a plurality of the lottery drawings by contributing tokens of value on behalf of the at least one grid unit;

receiving, from each player, a designated number of tokens to be contributed, on behalf of each of the at least one grid unit, to each of the plurality of the lottery drawings said player is committed to participate in; and executing the map-based game by doing the following for each lottery drawing:

pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize.

22. A computer-implemented method for lottery-style games, the method comprising using at least one processor and at least one storage medium for performing the following:

establishing a map-based game that is scheduled to have a number of lottery drawings associated with a map of a geographical area comprising a plurality of grid units wherein each grid unit represents a unique subset of the mapped geographical area;

causing a personal computing device to display at least a portion of the map to a player, thereby accepting enrollment of a plurality of players in the map-based game;

receiving from each player a selection of at least one grid unit on the map and an unconditional commitment to participate in a plurality of the lottery drawings by contributing tokens of value on behalf of the selected at least one grid unit;

storing digital data of the map, the plurality of grid units, and said each player's virtual ownership of said at least one grid unit on the map;

receiving, from each player, a designated number of tokens to be contributed, on behalf of each of the at least one grid unit, to each of the plurality of the lottery drawings said player is committed to participate in; and executing the map-based game by doing the following for each lottery drawing:

pooling tokens which are contributed to said lottery drawing on behalf of grid units participating in said lottery drawing, together with tokens carried over from one or more previous lottery drawings, if any, to form a jackpot for said lottery drawing, and conducting a drawing, from said grid units participating in said lottery drawing, to select at least one first grid unit to win a first prize.

* * * * *